US010982367B2

(12) United States Patent
Konzak et al.

(10) Patent No.: US 10,982,367 B2
(45) Date of Patent: Apr. 20, 2021

(54) DUAL-MOTOR SEWING MACHINE WITH AUTOMATIC TIMING ADJUSTMENT

(71) Applicant: HANDI QUILTER, INC., North Salt Lake, UT (US)

(72) Inventors: Gary J. Konzak, Salem, UT (US); Richard K. Eich, Layton, UT (US); Bryan K. Ruggles, Riverton, UT (US); Darren Denning, Sandy, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 33 days.

(21) Appl. No.: 16/358,363

(22) Filed: Mar. 19, 2019

(65) Prior Publication Data

US 2019/0292702 A1 Sep. 26, 2019

Related U.S. Application Data

(60) Provisional application No. 62/647,352, filed on Mar. 23, 2018.

(51) Int. Cl.

| | |
|---|---|
| ***D05B 69/30*** | (2006.01) |
| ***D05B 69/12*** | (2006.01) |
| ***D05B 11/00*** | (2006.01) |

(52) U.S. Cl.

CPC ..... *D05B 69/30* (2013.01); *D05B 11/00* (2013.01); *D05B 69/12* (2013.01)

(58) Field of Classification Search

CPC ..... D05B 69/00; D05B 69/30; D05B 69/12; D05B 69/24; D05B 69/28; D05B 11/00; D05B 19/12; D05B 19/14; D05B 19/16

USPC ..... 112/119, 470.12

See application file for complete search history.

(56) References Cited

U.S. PATENT DOCUMENTS

| | | | | |
|---|---|---|---|---|
| 3,515,080 A * | 6/1970 | Ramsey | ..... | D05B 23/00 112/470.13 |
| 4,955,305 A * | 9/1990 | Garnier | ..... | D05B 21/00 112/475.05 |
| 5,839,382 A * | 11/1998 | Tice | ..... | D05B 19/085 112/470.04 |

(Continued)

FOREIGN PATENT DOCUMENTS

| | | |
|---|---|---|
| CN | 101634087 A | 1/2010 |
| CN | 202017118 U | 10/2011 |
| CN | 102154787 B | 3/2013 |

*Primary Examiner* — Alissa L Hoey
*Assistant Examiner* — Patrick J. Lynch
(74) *Attorney, Agent, or Firm* — Maschoff Brennan

(57) ABSTRACT

Dual-motor sewing machine with automatic timing adjustment. In some embodiments, a sewing machine may include a frame, a needle bar configured to have a needle, a first motor configured to cause the needle bar to linearly reciprocate the needle with respect to the frame and into and out of a fabric, a first sensor configured to continuously sense a current position of the needle, a bobbin hook configured to function in connection with a bobbin, a second motor configured to cause the bobbin hook to rotate with respect to the frame, a second sensor configured to continuously sense a current position of the bobbin hook, and one or more motor controllers. The one or more motor controllers may be configured, based on the current positions sensed by the first sensor and the second sensor, to continuously and automatically adjust and synchronize timing of the first motor and/or the second motor.

19 Claims, 9 Drawing Sheets

(56) References Cited

U.S. PATENT DOCUMENTS

| | | | | |
|---|---|---|---|---|
| 6,959,657 | B1 * | 11/2005 | Duval | D05B 19/14 112/272 |
| 6,990,914 | B2 * | 1/2006 | Canan | D05B 11/00 112/119 |
| 7,789,028 | B2 * | 9/2010 | James | D05B 11/00 112/117 |
| 7,918,170 | B2 * | 4/2011 | Myers | D05B 11/00 112/117 |
| 8,297,211 | B2 * | 10/2012 | Stokes | D05B 11/00 112/102.5 |
| 9,617,673 | B1 | 4/2017 | Martelli | |
| 2002/0014190 | A1 * | 2/2002 | Ebata | D05C 9/22 112/102.5 |
| 2006/0112866 | A1 * | 6/2006 | Pfeifer | D05B 11/00 112/117 |
| 2009/0007829 | A1 * | 1/2009 | Shimizu | D05B 19/12 112/470.01 |
| 2014/0109814 | A1 * | 4/2014 | Fujiura | D05B 47/04 112/102.5 |
| 2016/0110087 | A1 * | 4/2016 | Eich | D05B 19/00 715/773 |
| 2016/0230322 | A1 * | 8/2016 | Schwarzberger | D05C 5/04 |
| 2016/0237604 | A1 * | 8/2016 | Nakajima | D05B 47/04 |
| 2016/0319473 | A1 * | 11/2016 | Schwarzberger | D05B 19/08 |
| 2016/0376739 | A1 * | 12/2016 | Spengler | D05B 21/00 112/117 |
| 2017/0260666 | A1 * | 9/2017 | Schwarzberger | D05B 19/12 |
| 2019/0119841 | A1 * | 4/2019 | Schwarzberger | D05B 11/00 |

* cited by examiner

DUAL-MOTOR SEWING MACHINE WITH AUTOMATIC TIMING ADJUSTMENT

CROSS-REFERENCE TO A RELATED APPLICATION

This application claims the benefit of, and priority to, U.S. Provisional Application No. 62/647,352, filed Mar. 23, 2018, which is incorporated herein by reference in its entirety.

BACKGROUND

Sewing machines generally function to form a row of stitches in one or more layers of fabric using a combination of thread from a spool, also known as top thread, and thread from a bobbin, also known as bottom thread. A sewing machine generally operates using a needle threaded with the top thread and a bobbin threaded with the bottom thread.

Once threaded, the sewing machine generally forms a row of stitches by repeatedly reciprocating the needle through the one or more layers of fabric while simultaneously rotating a bobbin hook underneath the one or more layers of fabric. In order to properly form the row of stitches, the reciprocating of the needle and the rotating of the bobbin hook must be precisely synchronized. This precise synchronization is generally accomplished using fixed mechanical linkages that link the needle to the bobbin hook so that a single motor can simultaneously reciprocate the needle and rotate the bobbin hook.

Unfortunately, however, the mechanical linkages that link the needle to the bobbin hook increase the parts, noise, vibration, and maintenance, and associated costs, of the sewing machine.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments, a dual-motor sewing machine with automatic timing adjustment may include a frame, a needle bar configured to have a needle threaded with a top thread, a first motor configured to cause the needle bar to substantially linearly reciprocate the needle with respect to the frame and into and out of a fabric, a first sensor configured to continuously sense a current position of the needle, a bobbin hook configured to function in connection with a bobbin threaded with a bottom thread, a second motor configured to cause the bobbin hook to rotate with respect to the frame, a second sensor configured to continuously sense a current position of the bobbin hook, and one or more motor controllers. The one or more motor controllers may be configured, based on the current positions sensed by the first sensor and the second sensor, to continuously and automatically adjust and synchronize timing of the first motor reciprocating the needle and/or the second motor rotating the bobbin hook in order to form stitches in the fabric with the top thread and the bottom thread.

In some embodiments, the first sensor and the second sensor may be configured as encoders that are configured to continually report current positions of the first motor and the second motor, respectively, which positions can be calculated over time to determine the current positions of the needle and the bobbin hook, respectively, that are linked thereto.

In some embodiments, the first sensor and the second sensor may be configured to continually track and report current positions of the needle and the bobbin hook, respectively, by directly monitoring the current positions of the needle and the bobbin hook.

In some embodiments, the second motor may be configured to rotate twice as fast as the first motor.

In some embodiments, the sewing machine may be configured as a carriage-mounted sewing machine that is repositioned by a user during operation while the fabric remains stationary.

In some embodiments, the sewing machine may be configured as a stationary sewing machine that remains stationary during operation while the fabric is repositioned by a user.

In some embodiments, the sewing machine may further include a third sensor configured to continuously sense a current sewing direction and a current sewing speed. In these embodiments, the one or more motor controllers may be further configured, based on the current sewing direction and the current sewing speed sensed by the third sensor, to continuously and automatically adjust and synchronize timing of the first motor reciprocating the needle and/or the second motor rotating the bobbin hook in order to form stitches in the fabric with the top thread and the bottom thread. In these embodiments, the sewing machine may further include a sewing machine carriage upon which the frame is mounted and which includes wheels configured to allow the sewing machine to sew in any x-y sewing direction, and the third sensor may be configured as an x-y encoder, such as an x-y quadrature encoder, associated with one or more wheels of the sewing machine carriage that is configured to continually report an x-y position of the sewing machine carriage to determine a current x-y sewing direction and x-y sewing speed of the sewing machine that is mounted upon the sewing machine carriage. Alternatively, in these embodiments, the third sensor may be an optical sensor configured to sense the repositioning of the fabric with respect to the frame to continuously sense the current sewing direction and current sewing speed in which the fabric is being repositioned by a user. Also, in these embodiments, the one or more motor controllers may be further configured to continuously and automatically determine an amount and direction of a bend that the needle is likely experiencing based on the current sewing direction and the current sewing speed, and the one or more motor controllers may be further configured to continuously and automatically compensate for the bend that the needle is likely experiencing by continuously and automatically adjusting and synchronizing the timing of the first motor reciprocating the needle and/or the second motor rotating the bobbin hook.

Also, in these embodiments, the sewing machine may further include a bobbin hook carriage configured to reposition the bobbin hook with respect to the frame, and the one or more motor controllers may be configured to continuously and automatically adjust and synchronize timing of the bobbin hook carriage repositioning the bobbin hook carriage with respect to the frame. In these embodiments, the one or more motor controllers may be further configured to continuously and automatically determine an amount and direction of a bend that the needle is likely experiencing based on the current sewing direction and the current sewing speed, and the one or more motor controllers may be further configured to continuously and automatically compensate for the bend that the needle is likely experiencing by continuously and automatically adjusting and synchronizing the timing of the bobbin hook carriage repositioning the bobbin hook carriage with respect to the frame.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DETAILED DESCRIPTION

Conventional sewing machines generally form rows of stitches using a single motor to simultaneously reciprocate a needle and rotate a bobbin hook. However, using a single motor requires conventional sewing machines to have mechanical linkages between the needle and the bobbin hook, which increases the parts, noise, vibration, and maintenance, and associated costs, of the sewing machine. Further, conventional sewing machines generally require a user to only sew in one sewing direction in order to maintain a precise synchronization between the reciprocating of the needle and the rotating of the bobbin hook.

Some embodiments disclosed herein employ a dual-motor sewing machine with automatic timing adjustment. In some embodiments, a dual-motor sewing machine may eliminate the mechanical linkages (such as belts, pulleys, and shafts) between the needle and the bobbin hook that are found in conventional sewing machines, thus resulting in decreased parts, noise, vibration, and maintenance, and associated costs, of the dual-motor sewing machine. In some embodiments, the dual-motor sewing machine disclosed herein may nevertheless maintain the capability of a conventional sewing machine to properly form rows of stitches by precisely synchronizing the reciprocating of the needle and the rotating of the bobbin hook. In some embodiments, this precise synchronization is accomplished using sensors configured to continuously sense the current positions of the needle and the bobbin hook and one or more motor controllers configured, based on the current positions sensed by the sensors, to continuously and automatically adjust and synchronize timing of the reciprocation of the needle and/or of the rotation of the bobbin hook in order to properly form stitches in the fabric. Further, in some embodiments, sensors that continuously sense the sewing speed and sewing direction are also employed in order for one or more motor controllers to continuously and automatically compensate for any resulting bend of the needle by adjusting and synchronizing timing of the reciprocation of the needle and/or of the rotation of the bobbin hook in order to properly form stitches in the fabric while sewing in any sewing direction and at any sewing speed. In this manner, not only are mechanical linkages between the needle and bobbin hook eliminated, but precise synchronization of timing between the needle and the bobbin hook is achieved while sewing in any sewing direction and at any sewing speed.

Figure 1A:
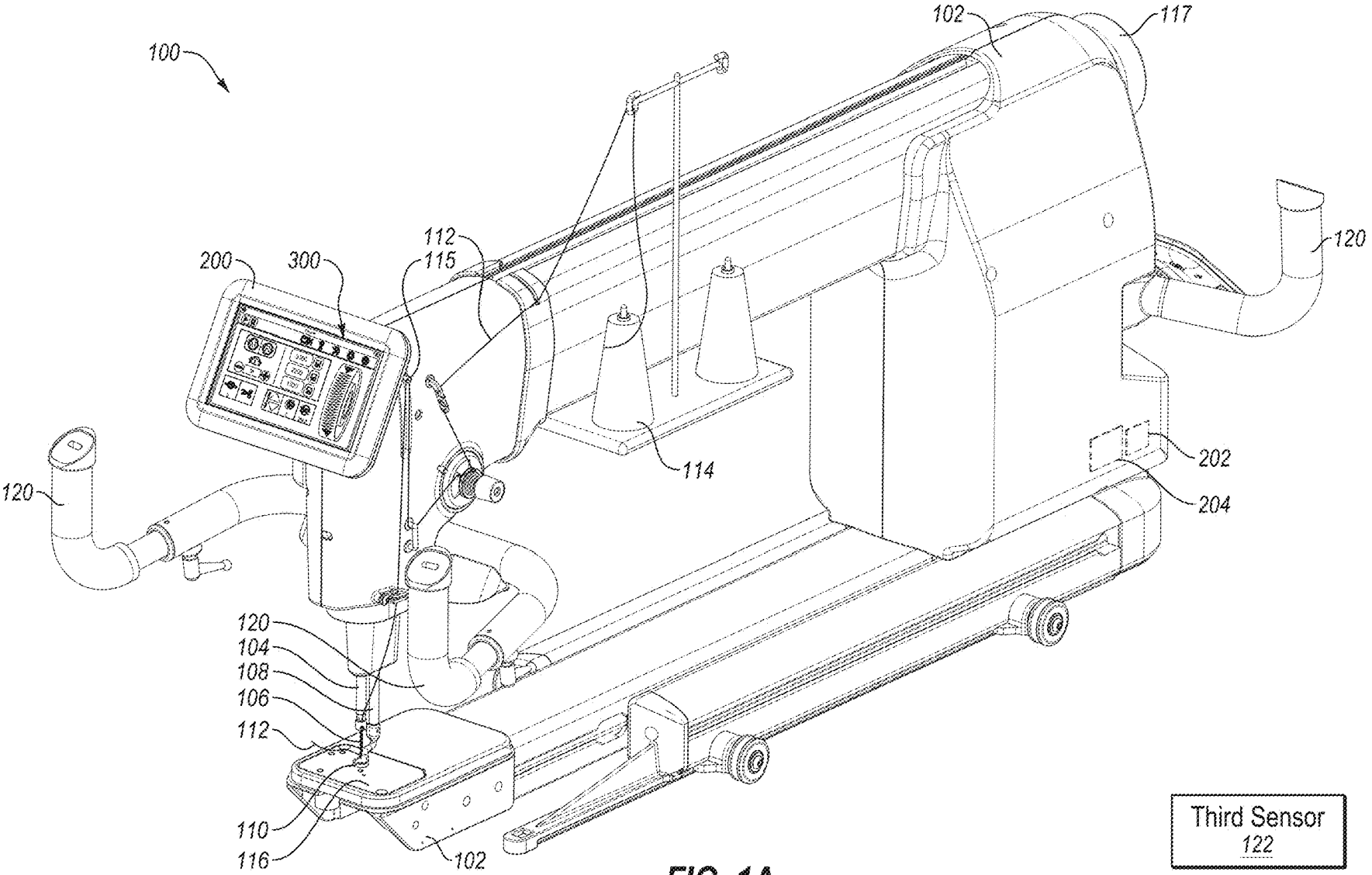
FIG. 1A is a front perspective view of an example sewing machine.
Figure 1B:
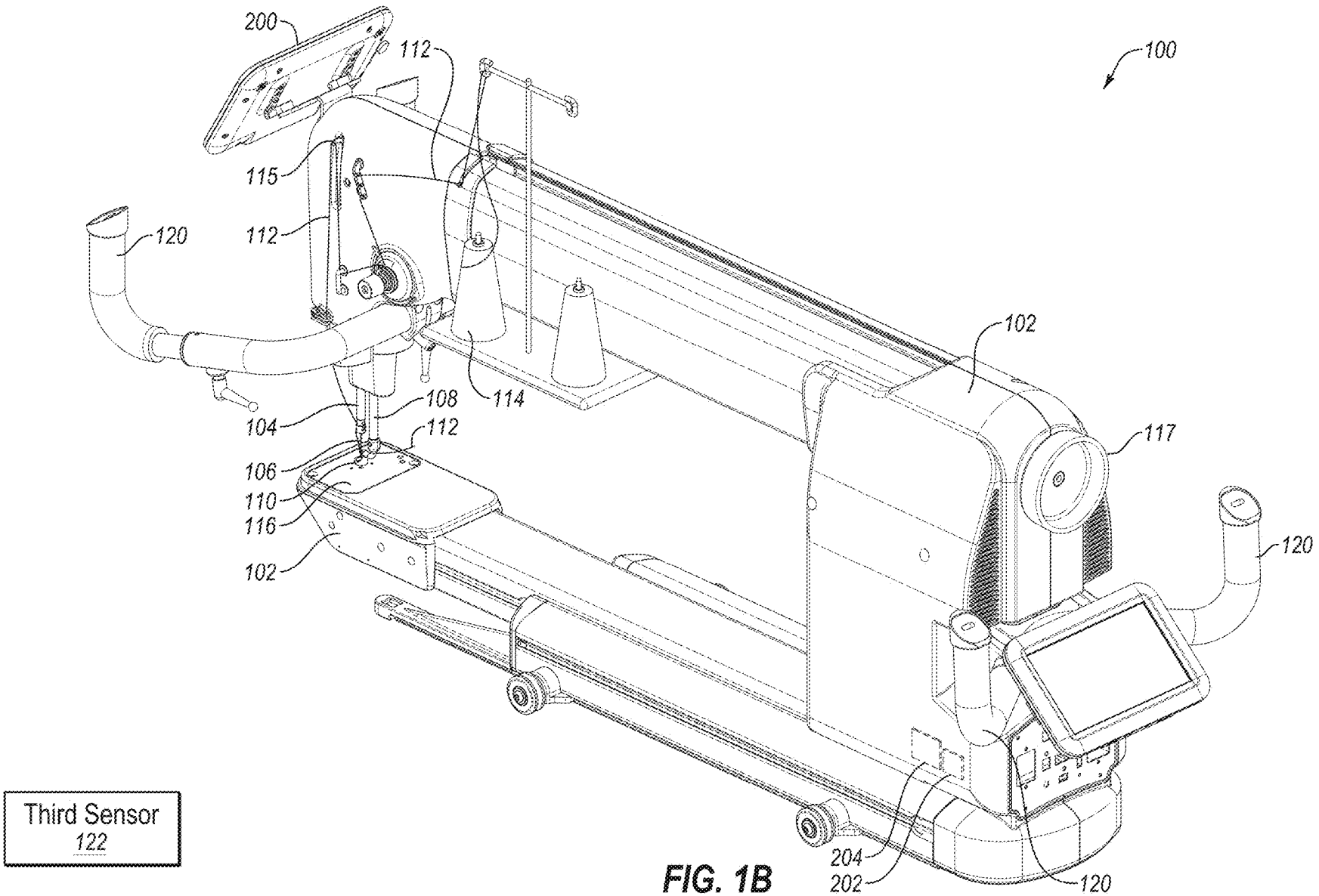
FIG. 1B is a rear perspective view of the example sewing machine of FIG. 1A.
Figure 2A:
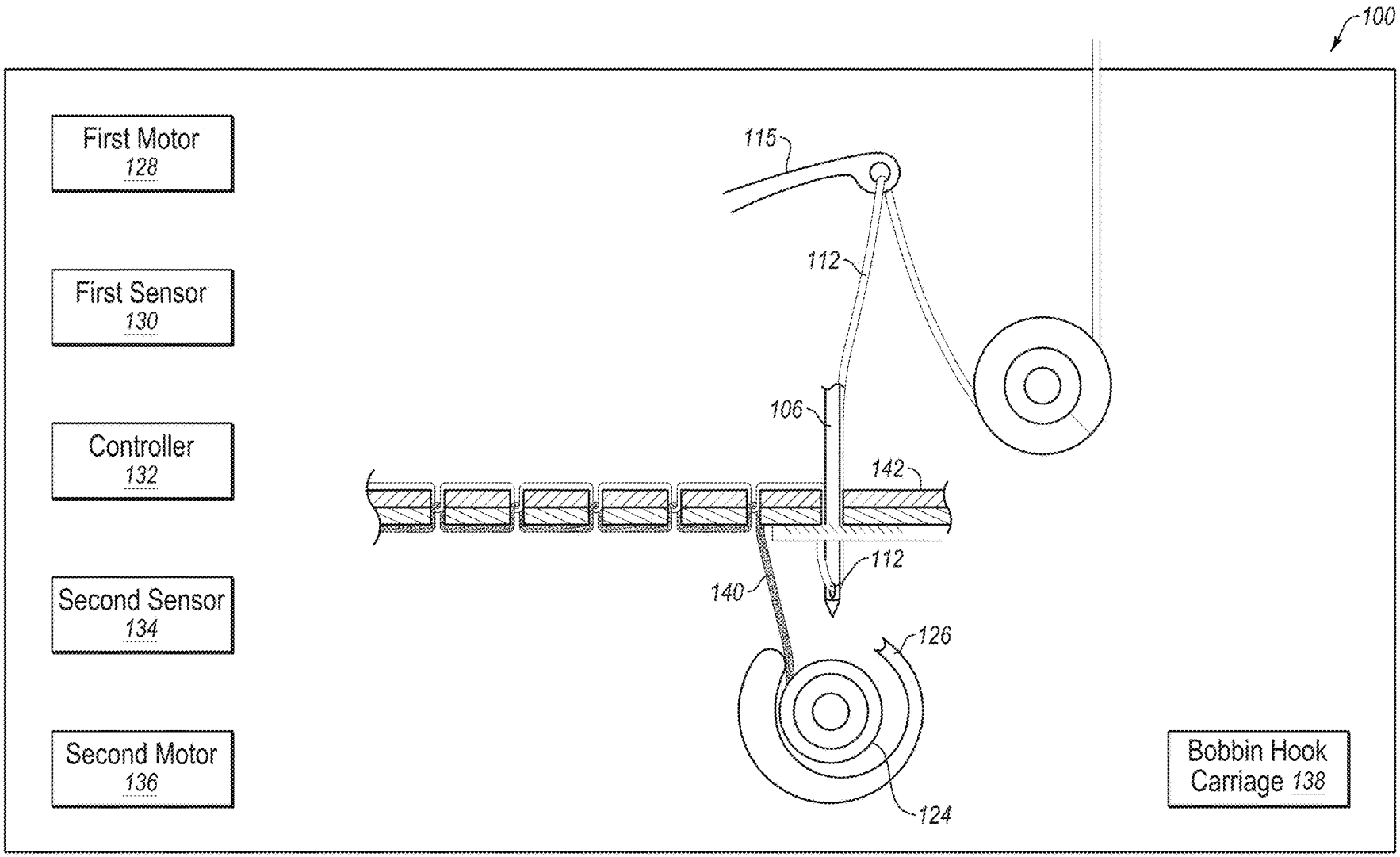
FIGS. 2A-2F illustrate internal operation of the example sewing machine of FIGS. 1A-1B.
Figure 2B:
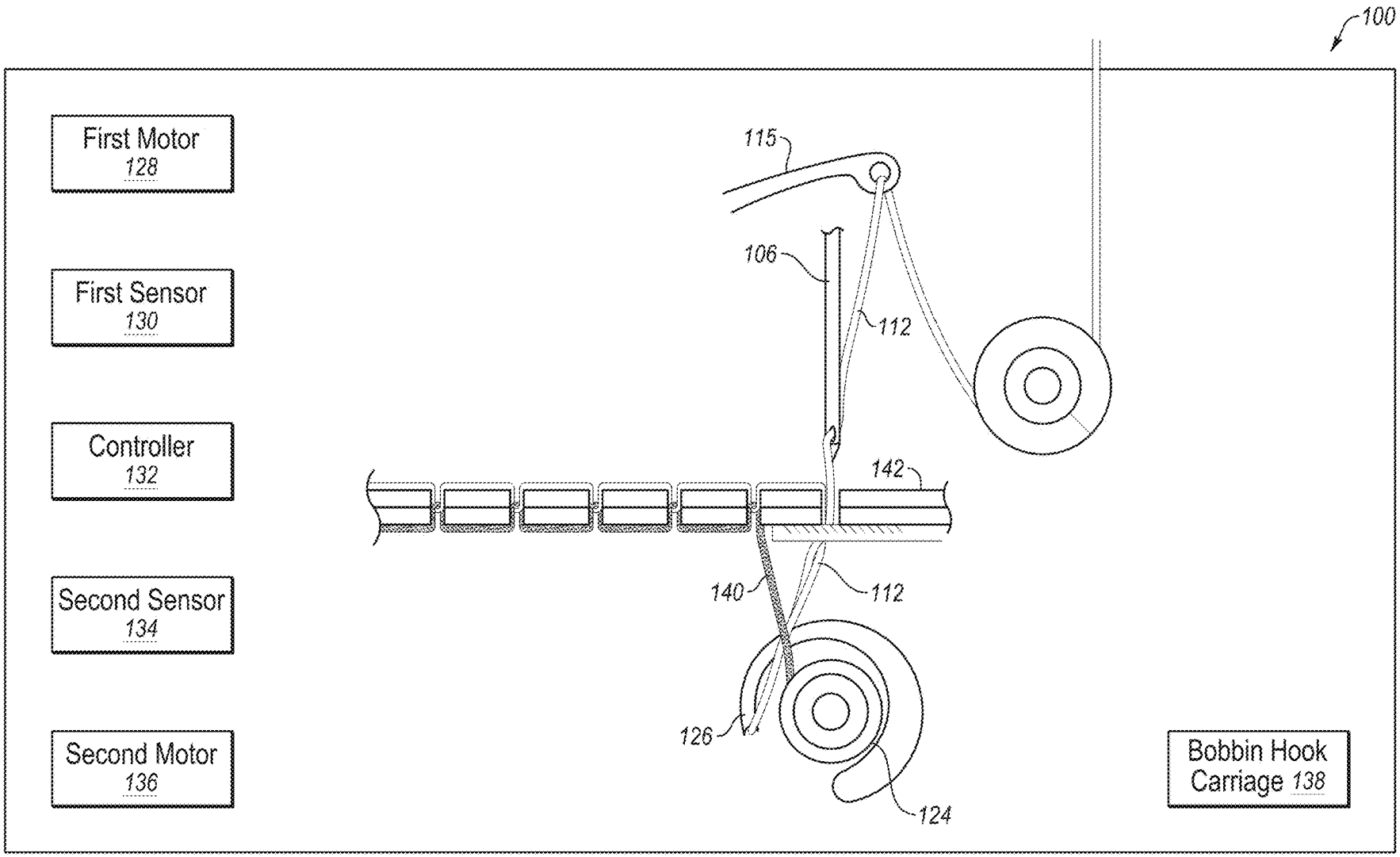
Figure 2C:
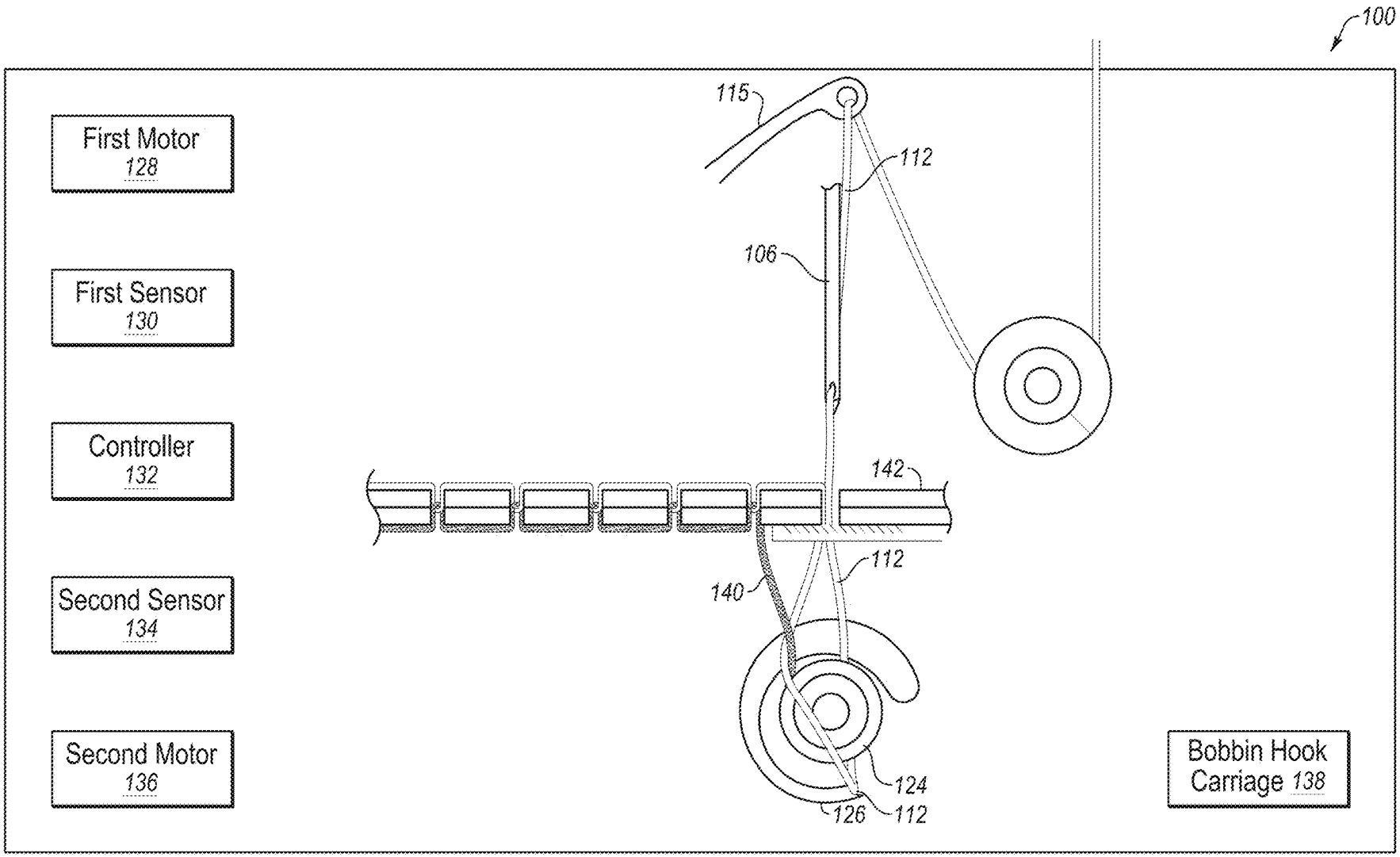
Figure 2D:
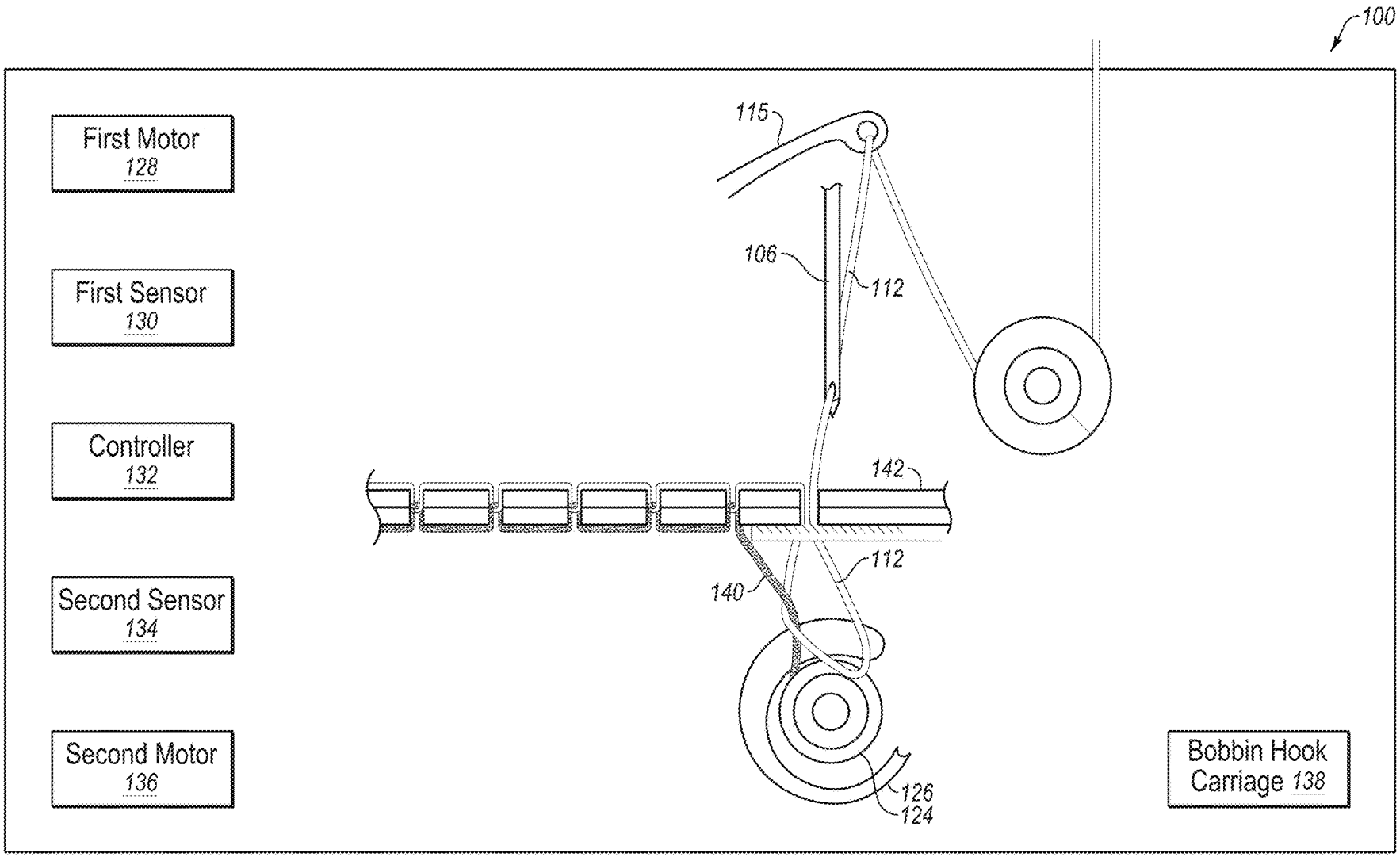
Figure 2E:
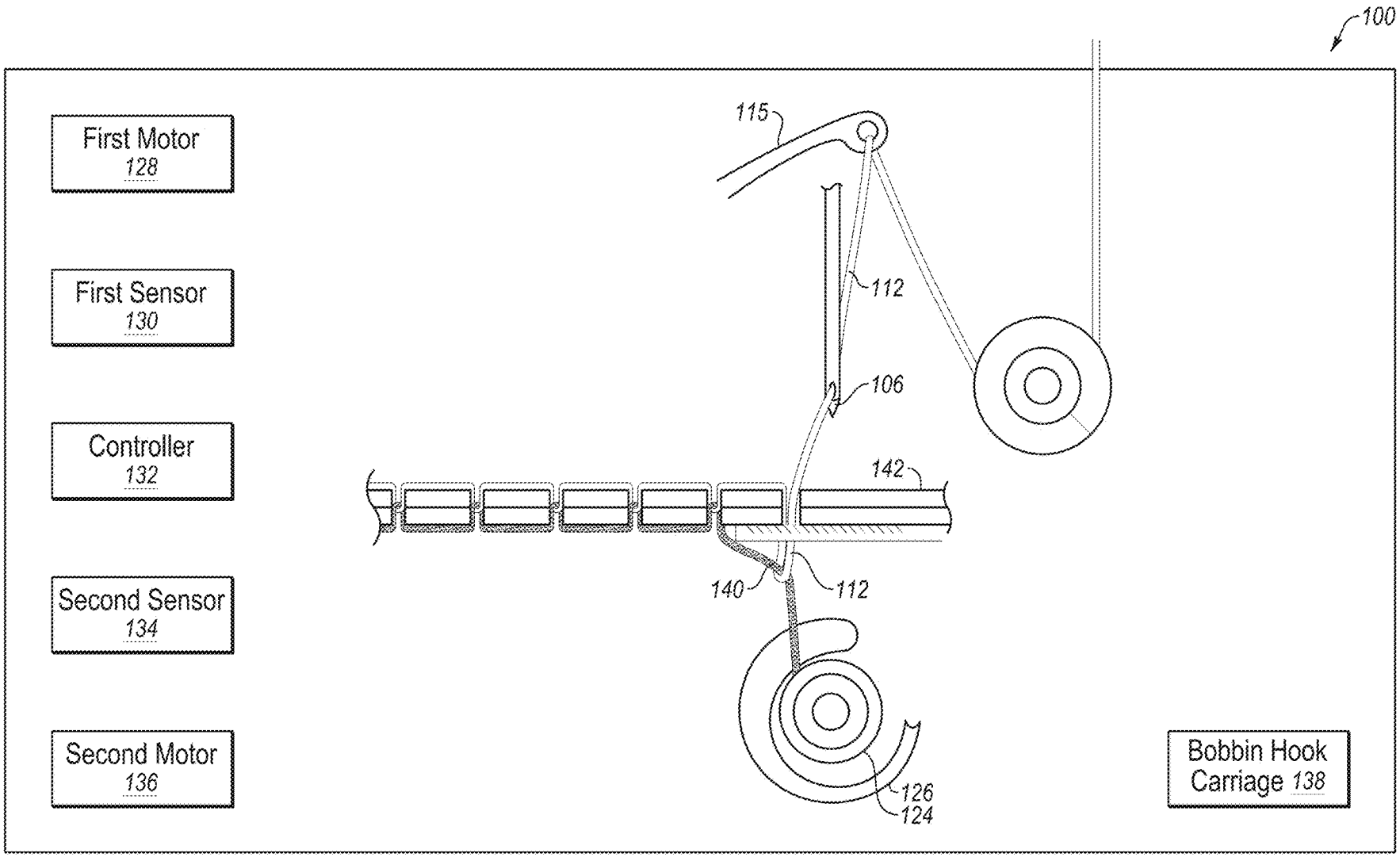
Figure 2F:
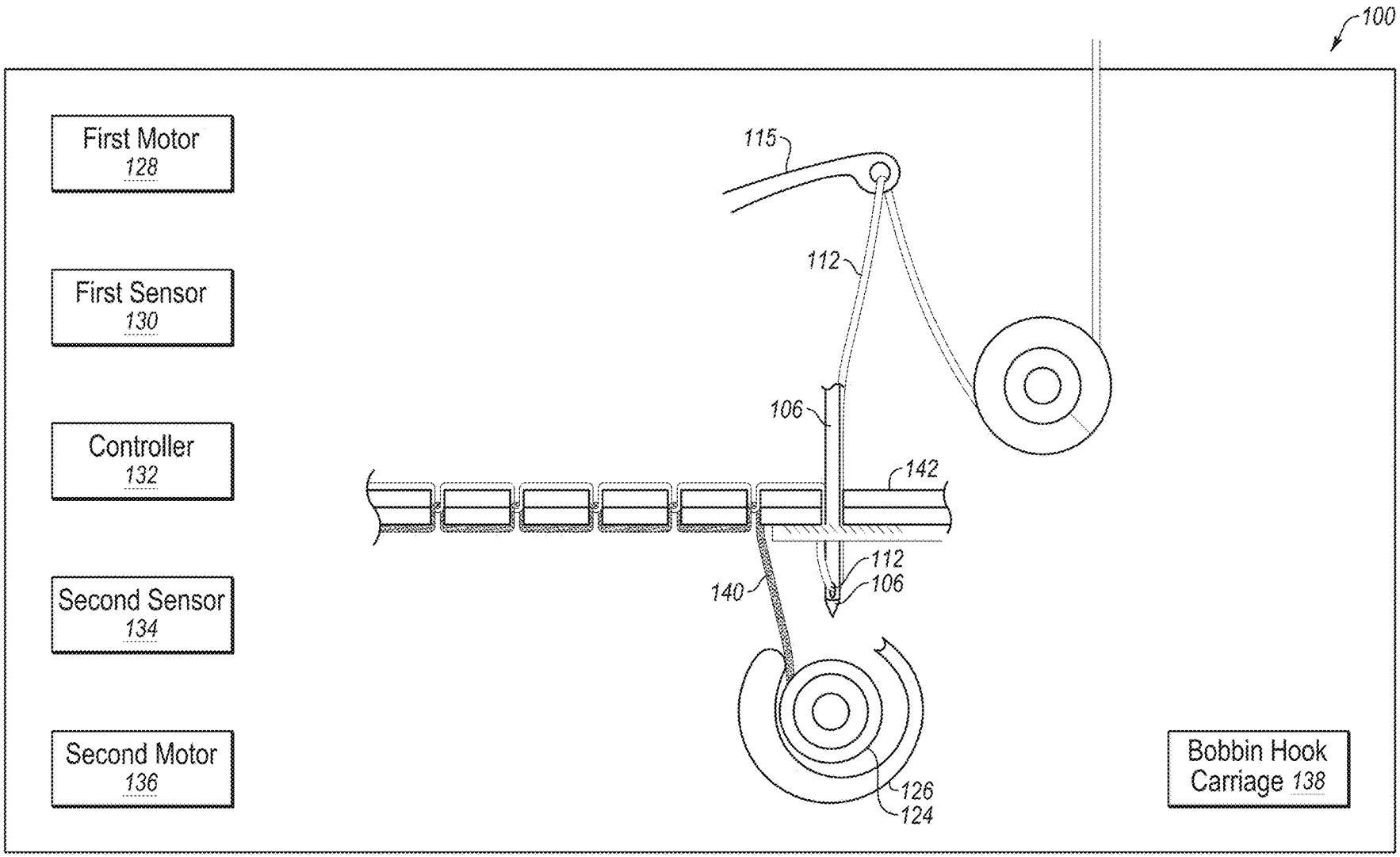

FIG. 1A is a front perspective view of an example sewing machine 100, and FIG. 1B is a rear perspective view of the example sewing machine 100. The example sewing machine 100 of FIGS. 1A and 1B is specialized for quilting and is known as a long-arm quilting machine. Quilting typically involves stitching together multiple layers of fabric to form a quilt. A quilt typically includes a layer of batting sandwiched in between upper and lower layers of fabric.

As disclosed in FIGS. 1A and 1B, the sewing machine 100 may include a frame 102 which houses various internal components of the sewing machine 100, some of which are disclosed in greater detail in FIGS. 2A-2F. The sewing machine 100 may also include a needle bar 104 that is configured to have a needle 106 attached thereto and a presser bar 108 having a hopping foot 110 attached thereto. A top thread 112 from a spool 114 may be passed through various thread guides, including a take-up lever 115, until finally the top thread 112 is threaded through the eye of the needle 106.

Although not shown in FIGS. 1A and 1B, it is understood that the sewing machine 100 may also include a bobbin case configured to hold a bobbin that is wound with bottom thread, and a bobbin hook, all generally positioned in the frame 102 underneath a needle plate 116, as disclosed in greater detail in FIGS. 2A-2F.

To facilitate the one or more layers of fabric remaining in a fixed position in a fabric frame (not shown) while sewing, in some embodiments the sewing machine 100 may be mounted upon a sewing machine carriage (not shown) which may allow a user to grasp handlebars 120 that are attached to the frame 102 and then reposition the sewing machine 100 while sewing over the one or more layers of fabric in any sewing direction and at any sewing speed. In some embodiments, the sewing machine carriage may be associated with a third sensor 122 configured to continuously sense the current sewing direction and current sewing speed in which the sewing machine 100 is sewing, as discussed in greater detail below. In some embodiments, the third sensor 122 may be an x-y encoder (such as a quadrature encoder) associated with one or more wheels of the sewing machine carriage that is configured to continually report the x-y position of the sewing machine carriage, which x-y positions can be calculated over time to determine the current sewing direction and sewing speed of the sewing machine 100 that is mounted upon the sewing machine carriage.

Although the example sewing machine 100 of FIGS. 1A and 1B is a long-arm quilting machine, it is understood that the sewing machine 100 of FIGS. 1A and 1B is only one of countless sewing machines in which the example automatic timing adjustments disclosed herein may be employed. The scope of the example automatic timing adjustments disclosed herein is therefore not intended to be limited to employment in any particular sewing machine.

FIGS. 2A-2F illustrate internal operation of the example sewing machine 100 of FIGS. 1A-1B. As disclosed in FIGS. 2A-2F, the sewing machine 100 may include the needle 106, the take-up lever 115, a bobbin 124, a bobbin hook 126, a first motor 128, a first sensor 130, a controller 132, a second sensor 134, a second motor 136, and a bobbin hook carriage 138.

With reference to FIGS. 1A-1B, and as disclosed in the progression from FIG. 2A to FIG. 2F, prior to operation of the sewing machine 100, the needle 106 may be threaded with the top thread 112, the bobbin 124 may be threaded with a bottom thread 140, the first sensor 130 may be configured to continuously sense the current position of the needle 106, the second sensor 134 may be configured to continuously sense the current position of the bobbin hook 126, and the bobbin hook 126 may be configured to function in connection with the bobbin 124. In some embodiments, the first sensor 130 and the second sensor 134 may be configured as encoders that are configured to continually report current positions of the first motor 128 and the second motor 136, respectively, which positions can be calculated over time to determine the current positions of the needle 106 and the bobbin hook 126, respectively that are linked thereto. In some embodiments, the first sensor 130 and the second sensor 134 may be configured as sensors that are configured to continually track and report current positions of the needle 106 and the bobbin hook 126, respectively, by directly monitoring the current positions of the needle 106 and the bobbin hook 126, instead of directly monitoring the current positions of the first motor 128 and the second motor 136, thus avoiding any inaccuracy due to any slippages in the linkages between the first motor 128 and the second motor 136 and the needle 106 and the bobbin hook 126, respectively.

Then, during operation of the sewing machine 100, the first motor 128 may be configured to cause the needle bar 104 to substantially linearly reciprocate the needle 106 with respect to the frame 102 and into and out of one or more layers of a fabric 142. Simultaneously, the first motor 128 may be configured to cause the presser bar 108 to substantially linearly reciprocate the hopping foot 110 onto and off of the fabric 142, to alternate between holding the one or more layers of the fabric 142 in place during the finalization of each stitch and releasing the one or more layers of the fabric 142 to facilitate the movement of the sewing machine 100 with respect to the fabric 142 between each stitch. Simultaneously, the second motor 136 may be configured to cause the bobbin hook 126 to rotate with respect to the frame 102 to repeatedly catch the top thread 112 (which has been driven through the one or more layers of fabric 142) and loop the top thread 112 around the bobbin 124, and then the take-up lever 115 may be driven (also by the first motor 128) to take up the top thread 112, to form a row of stitches, also known as lock stitches, of the top thread 112 and the bottom thread 140 in the one or more layers of the fabric 142. In some embodiments, the second motor 136 may rotate twice as fast as the first motor 128.

During operation of the sewing machine, the simultaneous operation of the first motor 128 and the second motor 136 may be synchronized by one or more motor controllers, such as the controller 132, which may be configured, based on the current positions sensed by the first sensor 130 and the second sensor 134, to continuously and automatically adjust and synchronize timing of the first motor 128 reciprocating the needle 106 and/or the second motor 136 rotating the bobbin hook 126, in order to properly form stitches in the fabric 142 with the top thread 112 and the bottom thread 140. In this manner, precise synchronization of timing between the needle 106 and the bobbin hook 126 may be achieved. Further, precise synchronization of timing between the needle 106 and the bobbin hook 126 may also be automatically corrected in real-time if the precise synchronization of timing is ever disrupted, such as when the machine is first powered on, or due to a broken needle, a broken bobbin hook, the needle inadvertently hitting a solid object such as a ruler, or any other malfunction of the sewing machine 100 that disrupts the synchronized timing. Therefore, if at any time the timing between the needle 106 and the bobbin hook 126 becomes unsynchronized, the controller 132 may automatically, and without human intervention, immediately detect this unsynchronized timing and then immediately resynchronize the timing to avoid skipping a stitch, shredding or breaking a thread, or other malfunction that may result from the unsynchronized timing.

Also, in some embodiments, the sewing machine may include the third sensor 122 that may be configured to continuously sense the current sewing direction and current sewing speed in which the sewing machine 100 is sewing. In these embodiments, the controller 132 may be further configured, based on the current sewing direction and the current sewing speed sensed by the third sensor 122, to continuously and automatically adjust and synchronize timing of the first motor 128 reciprocating the needle 106 and/or the second motor 136 rotating the bobbin hook 126 in order to properly form stitches in the fabric 142. In these embodiments, the current sewing direction and the current sewing speed of the sewing machine 100 may be relevant because the needle 106 may tend to bend against the fabric 142 in a direction that is opposite the current sewing direction due to movement of the sewing machine 100 (e.g., the needle 106 may bend to the left as the sewing machine is moved to the right), and the degree to which the needle 106 bends may increase as the current sewing speed of the sewing machine increases. Therefore, in these embodiments, the controller 132 may be configured to continuously and automatically determine the amount and direction of bend that the needle 106 is likely experiencing based on the current sewing direction and the current sewing speed of the sewing machine 100, and then continuously and automatically compensate for this bend of the needle 106 by adjusting and synchronizing timing of the first motor 128 reciprocating the needle 106 and/or the second motor 136 rotating the bobbin hook 126. This compensation may avoid the bend in the needle from causing the bobbin hook 126 to either reach the needle 106 too soon or too late and thereby disrupt the proper formation of stitches in the fabric 142. For example, this compensation may result in the rotation of the bobbin hook 126 being retarded or advanced to assure that it will catch the loop made by the top thread 112 in the proper position relative to the needle 106 so that a stitch is not skipped (or lost). Where the bobbin hook 126 rotates around an axis that runs front-to-back in the sewing machine, these embodiments may compensate for left-to-right or right to left movement of the sewing machine. Alternatively, where the bobbin hook 126 rotates around an axis that runs left-to-right in the sewing machine 100, these embodiments may compensate for front-to-back or back-to-front movement of the sewing machine 100. It is understood that although this compensation may instead result in the retarding or advancing of the needle 106, this alternative may change the stitch length, which may not be desirable.

Further, in some embodiments, the sewing machine may further include the bobbin hook carriage 138 which may be configured to reposition the bobbin hook 126 with respect to the frame 102. For example, the bobbin hook carriage 138 may be configured to travel within the frame 102, and thus reposition the bobbin hook 126 within the frame 102, left-to-right and right-to-left and/or front-to-back and back-to-front. In these embodiments, the controller 132 may be further configured, based on the current sewing direction and the current sewing speed sensed by the third sensor 122, to continuously and automatically adjust and synchronize timing of the bobbin hook carriage 138 repositioning the bobbin hook 126 with respect to the frame 102 in order to properly form stitches in the fabric 142. In these embodiments, the current sewing direction and current sewing speed of the sewing machine 100 may be relevant because, as noted above, the needle 106 may tend to bend against the fabric 142 in a direction that is opposite the current sewing direction due to movement of the sewing machine 100 (e.g., the needle 106 may bend forward as the sewing machine 100 is moved backward), and the degree to which the needle 106 bends may increase as the current sewing speed of the sewing machine increases. Therefore, in these embodiments, the controller 132 may be configured to continuously and automatically determine the amount and direction of bend that the needle 106 is likely experiencing based on the current sewing direction and current sewing speed of the sewing machine 100, and then continuously and automatically compensate for this bend of the needle 106 by adjusting and synchronizing timing of the bobbin hook carriage 138 repositioning the bobbin hook 126 with respect to the frame 102. This compensation may avoid the bend in the needle 106 from causing the bobbin hook 126 to miss the needle 106 bent to one side or the other of the bobbin hook 126, and/or from causing the bobbin hook 126 to reach the needle 106 too soon or too late, and thereby disrupt the proper formation of stitches in the fabric 142. Where the bobbin hook 126 rotates around an axis that runs left-to-right in the sewing machine 100, these embodiments may compensate for left-to-right or right-to-left movement (when the bobbin hook carriage 138 is configured to travel left-to-right or right-to-left), and/or front-to-back or back-to-front movement (when the bobbin hook carriage 138 is configured to travel front-to-back or back-to-front), of the sewing machine 100. Alternatively, where the bobbin hook 126 rotates around an axis that runs front-to-back in the sewing machine, these embodiments may compensate for front-to-back or back-to-front movement (when the bobbin hook carriage 138 is configured to travel front-to-back or back-to-front), and/or left-to-right or right-to-left movement (when the bobbin hook carriage 138 is configured to travel left-to-right or right-to-left), of the sewing machine 100.

Figure 3:
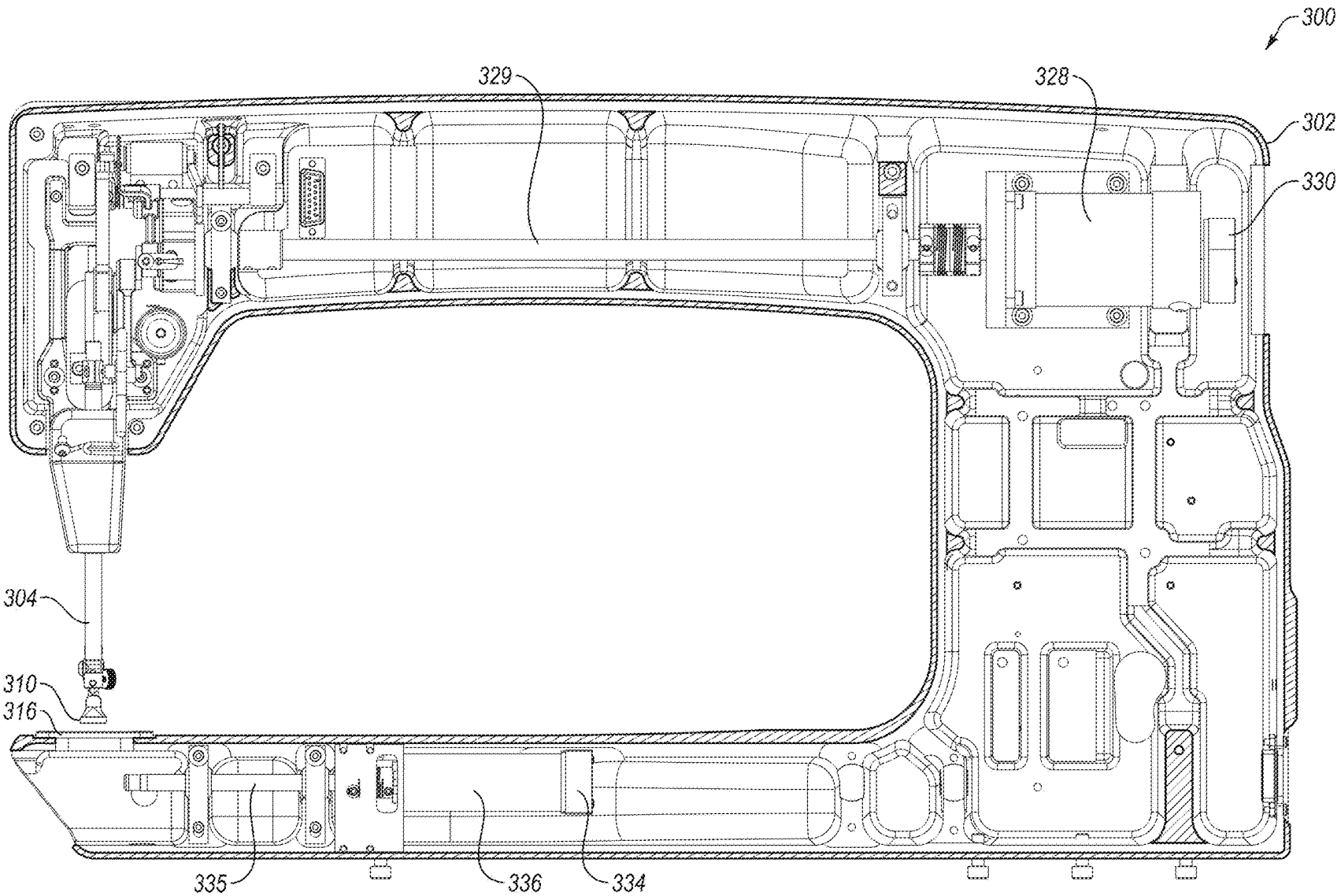
FIG. 3 is a cross-sectional side view of another example sewing machine.

FIG. 3 is a cross-sectional side view of another example sewing machine 300. Similar to the sewing machine 100 of FIGS. 1A-2F, the sewing machine 300 of FIG. 3 is a long-arm quilting machine. The structure and functionality of the sewing machine 300 of FIG. 3 is similar to the structure and functionality of the sewing machine 100 of FIGS. 1A-2F. In particular, the sewing machine 300 of FIG. 3 may include all the same automatic timing adjustment functionality as the sewing machine 100 of FIGS. 1A-2F. Therefore, the discussion herein of the sewing machine 300 will only briefly describe certain components of the sewing machine 300.

As disclosed in FIG. 3, the sewing machine 300 may include a frame 302 which houses various internal components of the sewing machine 300, only some of which are disclosed in FIG. 3. The sewing machine 300 may include a needle bar 304 that is configured to have a needle (not shown) attached thereto and a presser bar (hidden in FIG. 3 behind the needle bar 304) having a hopping foot 310 attached thereto. Although not shown in FIG. 3, it is understood that the sewing machine 300 may also include a bobbin case configured to hold a bobbin as well as a bobbin hook attached to a second drive shaft 335, all generally positioned in the frame 102 underneath a needle plate 316.

To facilitate the one or more layers of fabric remaining in a fixed position in a fabric frame (not shown) while sewing, in some embodiments the sewing machine 300 may be mounted upon a sewing machine carriage (not shown) which may allow a user to grasp handlebars (not shown) that are attached to the frame 102 and then reposition the sewing machine 300 while sewing over the one or more layers of fabric in any sewing direction and at any sewing speed. In some embodiments, the sewing machine carriage may be associated with a third sensor (not shown) configured to continuously sense the current sewing direction and current sewing speed in which the sewing machine 300 is sewing, as discussed in greater detail above.

As disclosed in FIG. 3, the sewing machine 300 may include, internal to the frame 302, a first motor 328, a first sensor 330, a controller (not shown), a second sensor 334, a second motor 336, and a bobbin hook carriage (not shown), each of which may function similarly as the corresponding component in the sewing machine 100 discussed above. Also, as discussed above, the first sensor 330 and the second sensor 334 are configured in the sewing machine 300 as encoders that are configured to continually report current positions of the first motor 328 and the second motor 336, respectively, which positions can be calculated over time to determine the current positions of the needle (not shown) and the bobbin hook (not shown) of the sewing machine 300, respectively, that are linked thereto. In some embodiments, the first motor 328 and the first sensor 330 may be positioned closer to the front of the sewing machine 300 in order to reduce the length of a first drive shaft 329. Similarly, in some embodiments, the second motor 336 and the second sensor 334 may be positioned closer to the front of the sewing machine 300 in order to reduce the length of a second drive shaft 335. Reducing the lengths of the first drive shaft 329 and/or the second drive shaft 335 may reduce vibration in the sewing machine 300.

Although the example sewing machine 300 of FIG. 3 is a long-arm quilting machine, it is understood that the sewing machine 300 of FIG. 3 is only one of countless sewing machines in which the example automatic timing adjustments disclosed herein may be employed. The scope of the example automatic timing adjustments disclosed herein is therefore not intended to be limited to employment in any particular sewing machine.

In some embodiments, the automatic timing adjustments disclosed herein may alternatively be accomplished in a single-motor sewing machine. For example, using an inline clutch mechanism in the mechanical linkages between the needle and the bobbin hook, the same sensors could be employed to automatically detect if, at any time, the timing between the needle and the bobbin hook becomes unsynchronized. Then the same controller may automatically, and without human intervention, immediately detect this unsynchronized timing and then immediately resynchronize the timing by adjusting the mechanical linkages using the inline clutch mechanism to avoid skipping a stitch, shredding or breaking a thread, or other malfunction that may result from the unsynchronized timing. Therefore, the automatic timing adjustments disclosed herein are not limited to a dual-motor sewing machine, but may also be implemented in a single-motor sewing machine.

Additionally or alternatively, in some embodiments, the automatic timing adjustments disclosed herein may alternatively be accomplished in a dual-motor or single-motor sewing machine that is stationary, as opposed to a carriage-mounted sewing machine that is mounted on a sewing machine carriage. For example, the third sensor discussed herein may be configured to continuously sense the current sewing direction and current sewing speed in which the fabric that is being sewn by a stationary sewing machine is being repositioned by a user, instead of sensing the current sewing direction and current sewing speed in which a carriage-mounted sewing machine is sewing stationary fabric. In these embodiments, the third sensor may be an optical sensor, for example, that senses the movement of the fabric with respect to a frame of the stationary sewing machine. Therefore, the automatic timing adjustments disclosed herein are not limited to a carriage-mounted sewing machine where the fabric remains stationary during sewing, but may also be implemented in a stationary sewing machine where the fabric is constantly being repositioned by the user during sewing.

The embodiments described herein may include the use of a special-purpose or general-purpose computer, including various computer hardware or software modules, as discussed in greater detail below.

Embodiments of the motors, controllers, and sensors described herein may be implemented using non-transitory computer-readable media for carrying or having computer-executable instructions or data structures stored thereon. Such computer-readable media may be any available media that may be accessed by a general-purpose or special-purpose computer. By way of example, and not limitation, such computer-readable media may include non-transitory computer-readable storage media including RAM, ROM, EEPROM, CD-ROM or other optical disk storage, magnetic disk storage or other magnetic storage devices, or any other storage medium which may be used to carry or store one or more desired programs having program code in the form of computer-executable instructions or data structures and which may be accessed and executed by a general-purpose computer, special-purpose computer, or virtual computer such as a virtual machine. Combinations of the above may also be included within the scope of computer-readable media.

Computer-executable instructions comprise, for example, instructions and data which, when executed by one or more processors, cause a general-purpose computer, special-purpose computer, or virtual computer such as a virtual machine to perform a certain method, function, or group of methods or functions. Although the subject matter has been described in language specific to structural features and/or methodological steps, it is to be understood that the subject matter defined in the appended claims is not necessarily limited to the specific features or steps described above. Rather, the specific features and steps described above are disclosed as example forms of implementing the claims.

As used herein, the term "program" may refer to software objects or routines that execute on a computing system. The different programs described herein may be implemented as objects or processes that execute on a computing system (e.g., as separate threads). While the GUIs described herein are preferably implemented in software, implementations in hardware or a combination of software and hardware are also possible and contemplated.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A dual-motor sewing machine with automatic timing adjustment, the sewing machine comprising:

a frame;

a needle bar configured to have a needle threaded with a top thread;

a first motor configured to cause the needle bar to reciprocate the needle with respect to the frame and into and out of a fabric;

a first sensor configured to continuously sense a current position of the needle;

a bobbin hook configured to function in connection with a bobbin threaded with a bottom thread;

a second motor configured to cause the bobbin hook to rotate with respect to the frame;

a second sensor configured to continuously sense a current position of the bobbin hook;

a third sensor configured to continuously sense a current sewing direction and a current sewing speed; and one or more motor controllers configured, based on the current positions received from the first sensor and the second sensor and based on the current sewing direction and the current sewing speed received from the third sensor, to:

continuously and automatically determine an amount and direction of a bend that the needle is likely experiencing based on the current sewing direction and the current sewing speed received from the third sensor, the bend that the needle is likely experiencing being in a direction that is opposite the current sewing direction and being to a degree that increases as the current sewing speed increases; and continuously and automatically compensate for the bend that the needle is likely experiencing by continuously and automatically synchronizing timing of the first motor reciprocating the needle and the second motor rotating the bobbin hook, in order to form stitches in the fabric with the top thread and the bottom thread, and in order to avoid the bend that the needle is likely experiencing from causing the bobbin hook to either reach the needle too soon or too late and thereby disrupt the formation of the stitches in the fabric.

2. The sewing machine of claim 1, wherein the first sensor and the second sensor are configured as encoders that are configured to continually report current positions of the first motor and the second motor, respectively, which positions can be calculated over time to determine the current positions of the needle and the bobbin hook, respectively, that are linked thereto.

3. The sewing machine of claim 1, wherein: the first sensor and the second sensor are configured to continually track and report current positions of the needle and the bobbin hook, respectively, by directly monitoring the current positions of the needle and the bobbin hook; and the first sensor and the second sensor are not configured to continually report current positions of the first motor and the second motor, respectively.

4. The sewing machine of claim 1, wherein:

the sewing machine is configured as a carriage-mounted sewing machine that is configured to be manually repositioned by a user during sewing while the fabric remains stationary;

the current sewing direction is an x-y sewing direction in which the carriage-mounted sewing machine is currently being manually repositioned by the user during sewing; and the current sewing speed is an x-y sewing speed at which the carriage-mounted sewing machine is currently being manually repositioned by the user during sewing.

5. The sewing machine of claim 4, wherein:

the sewing machine is a long-arm quilting machine;

the long-arm quilting machine further comprises handlebars attached to the frame and a presser bar configured to have a hopping foot attached thereto; and the first motor is further configured to cause the presser bar to reciprocate the hopping foot with respect to the frame and onto and off of the fabric.

6. The sewing machine of claim 4, wherein:

the sewing machine further comprises a sewing machine carriage upon which the frame is mounted and which includes wheels configured to allow the sewing machine to sew in any x-y sewing direction; and the third sensor is configured as an x-y encoder associated with one or more wheels of the sewing machine carriage that is configured to continually report an x-y position of the sewing machine carriage to determine a current x-y sewing direction and x-y sewing speed of the sewing machine that is mounted upon the sewing machine carriage.

7. The sewing machine of claim 6, wherein the x-y encoder is an x-y quadrature encoder.

8. The sewing machine of claim 1, wherein:

the sewing machine is configured as a stationary sewing machine that is configured to remain stationary during sewing while the fabric is manually repositioned by a user;

the current sewing direction is an x-y sewing direction in which the fabric is currently being manually repositioned by the user during sewing; and the current sewing speed is an x-y sewing speed at which the fabric is currently being manually repositioned by the user during sewing.

9. The sewing machine of claim 8, wherein the third sensor is an optical sensor configured to sense repositioning of the fabric with respect to the frame to continuously sense the current sewing direction and current sewing speed in which the fabric is being repositioned by the user.

10. A dual-motor sewing machine with automatic timing adjustment, the sewing machine comprising:

a frame;

a needle bar configured to have a needle threaded with a top thread;

a first motor configured to cause the needle bar to reciprocate the needle with respect to the frame and into and out of a fabric;

a first sensor configured to continuously sense a current position of the needle;

a bobbin hook configured to function in connection with a bobbin threaded with a bottom thread;

a bobbin hook carriage configured to reposition the bobbin hook left-and-right and/or front-and-back with respect to the frame;

a second motor configured to cause the bobbin hook to rotate with respect to the frame;

a second sensor configured to continuously sense a current position of the bobbin hook;

a third sensor configured to continuously sense a current sewing direction and a current sewing speed; and one or more motor controllers configured, based on the current positions sensed by the first sensor and the second sensor and based on the current sewing direction and the current sewing speed sensed by the third sensor, to continuously and automatically synchronize timing of the first motor reciprocating the needle and the second motor rotating the bobbin hook, and to continuously and automatically synchronize timing of the bobbin hook carriage repositioning the bobbin hook to the left, to the right, to the front, or to the back, or some combination thereof with respect to the frame, in order to form stitches in the fabric with the top thread and the bottom thread.

11. The sewing machine of claim 10, wherein:

the first sensor and the second sensor are configured as encoders that are configured to continually report current positions of the first motor and the second motor, respectively, which positions can be calculated over time to determine the current positions of the needle and the bobbin hook, respectively, that are linked thereto.

12. The sewing machine of claim 10, wherein:

the sewing machine is configured as a carriage-mounted sewing machine that is configured to be manually repositioned by a user during sewing while the fabric remains stationary;

the current sewing direction is an x-y sewing direction in which the carriage-mounted sewing machine is currently being manually repositioned by the user during sewing;

the current sewing speed is an x-y sewing speed at which the carriage-mounted sewing machine is currently being manually repositioned by the user during sewing;

the sewing machine further comprises a sewing machine carriage upon which the frame is mounted and which includes wheels configured to allow the sewing machine to sew in any x-y sewing direction; and the third sensor is configured as an x-y encoder associated with one or more wheels of the sewing machine carriage that is configured to continually report an x-y position of the sewing machine carriage to determine a current x-y sewing direction and x-y sewing speed of the sewing machine that is mounted upon the sewing machine carriage.

13. The sewing machine of claim 10, wherein:

the sewing machine is configured as a stationary sewing machine that is configured to remain stationary during sewing while the fabric is manually repositioned by a user;

the current sewing direction is an x-y sewing direction in which the fabric is currently being manually repositioned by the user during sewing;

the current sewing speed is an x-y sewing speed at which the fabric is currently being manually repositioned by the user during sewing; and the third sensor is an optical sensor configured to sense repositioning of the fabric with respect to the frame to continuously sense the current sewing direction and current sewing speed in which the fabric is being repositioned by the user.

14. The sewing machine of claim 10, wherein:

the one or more motor controllers further configured to continuously and automatically determine an amount and direction of a bend that the needle is likely experiencing based on the current sewing direction and the current sewing speed sensed by the third sensor; and the one or more motor controllers further configured to continuously and automatically compensate for the bend that the needle is likely experiencing by:

continuously and automatically synchronizing the timing of the first motor reciprocating the needle and the second motor rotating the bobbin hook; and continuously and automatically synchronizing the timing of the bobbin hook carriage repositioning the bobbin hook carriage to the left, to the right, to the front, or to the back, or some combination thereof with respect to the frame.

15. The sewing machine of claim 4, wherein the carriage-mounted sewing machine is configured to be manually repositioned by the user during at least a portion of a time period in which the needle is positioned in the fabric.

16. The sewing machine of claim 8, wherein the stationary sewing machine is configured to allow the fabric to be manually repositioned by the user during at least a portion of a time period in which the needle is positioned in the fabric.

17. The sewing machine of claim 10, wherein:

the first sensor and the second sensor are configured to continually track and report current positions of the needle and the bobbin hook, respectively, by directly monitoring the current positions of the needle and the bobbin hook.

18. The sewing machine of claim 12, wherein the carriage-mounted sewing machine is configured to be manually repositioned by the user during at least a portion of a time period in which the needle is positioned in the fabric.

19. The sewing machine of claim 13, wherein the stationary sewing machine is configured to allow the fabric to be manually repositioned by the user during at least a portion of a time period in which the needle is positioned in the fabric.

* * * * *